United States Patent [19]

Baird

[11] Patent Number: 4,966,566

[45] Date of Patent: Oct. 30, 1990

[54] RAISING AND LOWERING AID FOR TROLLING MOTORS

[76] Inventor: John S. Baird, 9600 Baird Rd., Shreveport, La. 71118

[21] Appl. No.: 239,222

[22] Filed: Sep. 1, 1988

[51] Int. Cl.[5] ..... B63H 21/26

[52] U.S. Cl. ..... 440/6; 248/642; 440/55; 440/63

[58] Field of Search ..... 440/6, 7, 55, 63; 248/641, 642

[56] References Cited

U.S. PATENT DOCUMENTS 2,901,194 8/1959 Shontz ..... 248/642

*Primary Examiner*—Sherman Basinger

*Attorney, Agent, or Firm*—John M. Harrison

[57] ABSTRACT

A spring-biased mechanism that connects to and cooperates with a trolling motor mount is provided to partially counterbalance the weight of the trolling motor as it pivoted from an intermediate position into operating position and back again, thereby making easier the effort normally exerted by the operator to lower the trolling motor into the water, as well as to raise it from the water, which mechanism includes a foot element that pivotally attaches at one end to the trolling motor mount, a linear-acting spring unit having one end pivotally attached to one end of the foot element and means that pivotally connect the opposite end of the foot element to a portion of the spring unit.

25 Claims, 4 Drawing Sheets

FIG. 1
(PRIOR ART)
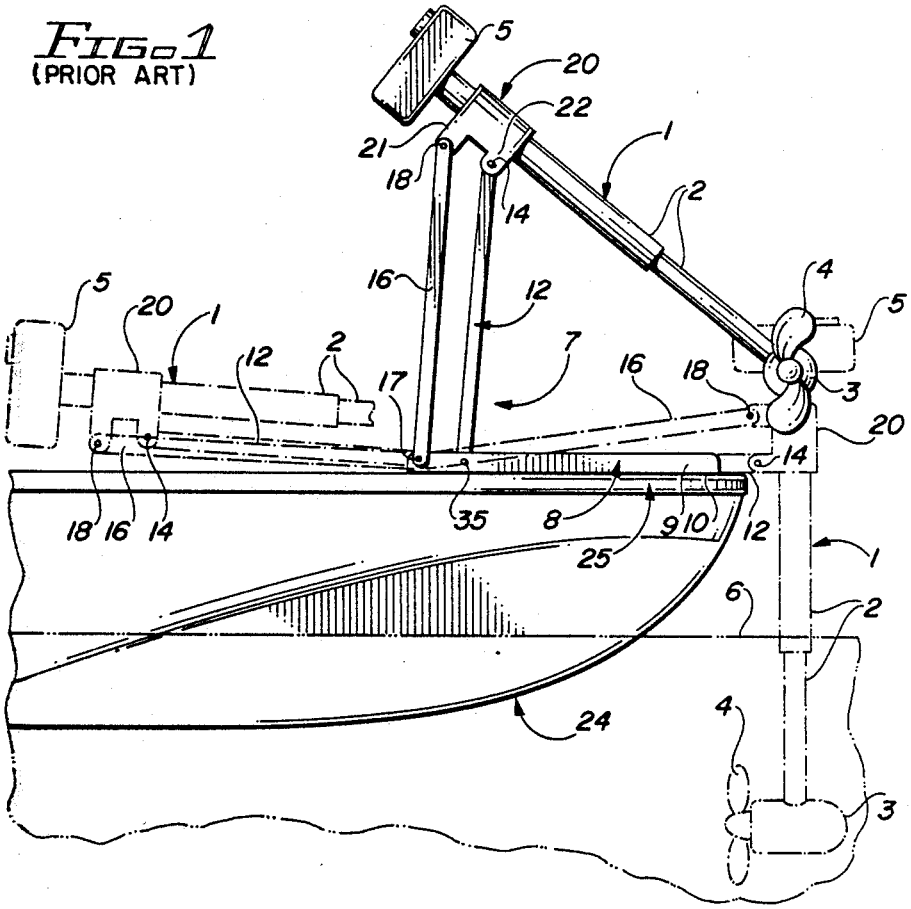
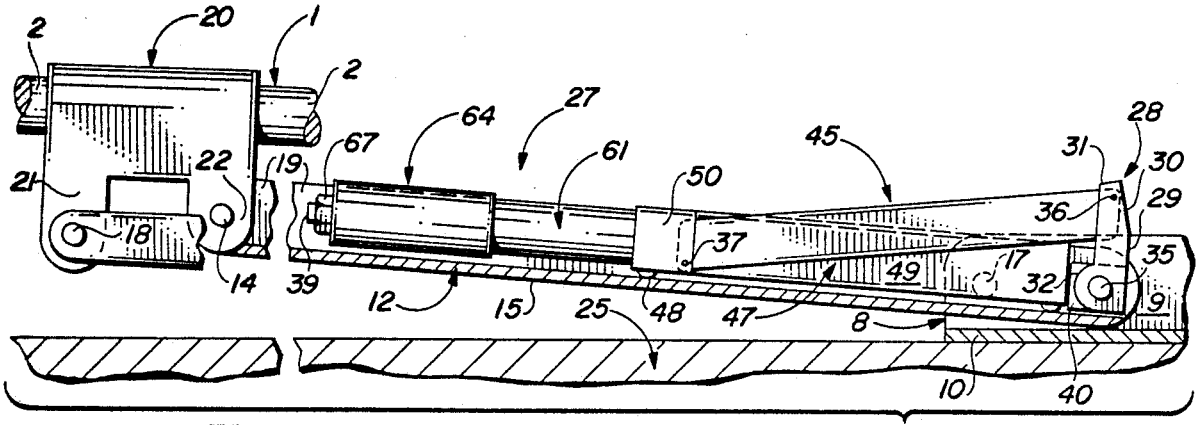
FIG. 4 FIG. 3
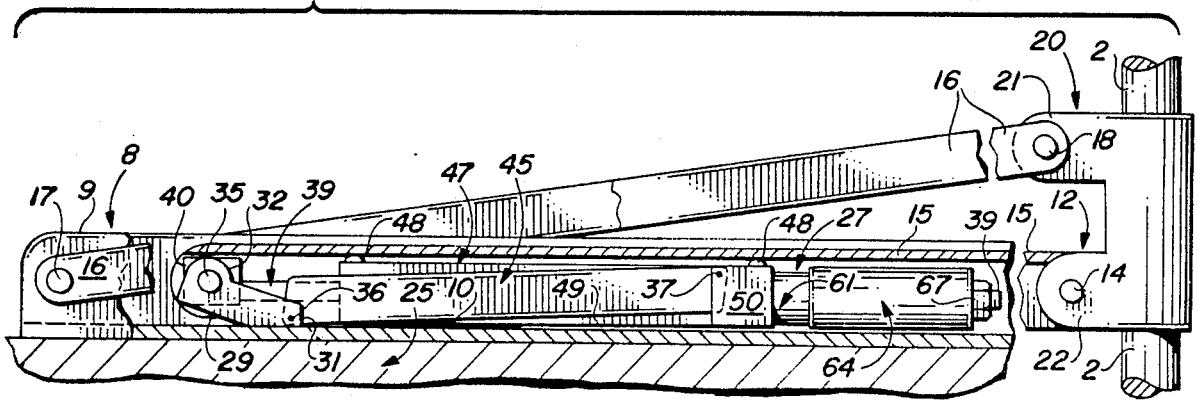

RAISING AND LOWERING AID FOR TROLLING MOTORS

Background of the Invention

1. Field of the Invention

This invention relates to trolling motors for fishing boats. More particularly, the invention relates to a raising and lowering aid that attaches to a trolling motor mount and serves to partially counterbalance the weight of the trolling motor to help lift the trolling motor from the water and to cushion the drop of the trolling motor into the water during the raising and lowering operation. In a preferred embodiment of the invention, the raising and lowering aid is characterized by a foot member pivotally attached to the trolling motor mount, linear-acting resilient means having one end pivotally attached to one end of the foot member and means pivotally connecting the opposite end of the resilient means to the opposite end of the foot member. The raising and lowering aid of this invention is designed for compatibility with conventional mount brackets which accommodate state-of-the-art retractable trolling motors, and it can be quickly and easily attached to assist the user in raising and lowering the trolling motor.

2. Description of the Prior Art

Trolling motors of various design are currently used in order to more efficiently position a boat while fishing or docking or in other low speed propulsion situations. Various types of brackets for mounting outboard motors and trolling motors are known in the art. "An Adjustable Retracting Outboard Motor Bracket" is disclosed in U.S. Pat. No. 3,032,304, dated May 1, 1962, to H. A. Machlan. Similar brackets are detailed in U.S. Pat. No. 3,629,885, dated Dec. 28, 1971, to Ralph E. Jackson and U.S. Pat. No. 3,861,628, dated Jan. 21, 1975, to George H. Krieger. Other trolling motor brackets include a shock absorbing means. Typical of these patents is U.S. Pat. No. 3,915,417, dated Oct. 28, 1975, to Don S. Norton. The assembly includes a spring-loaded, shock-absorbing supporting bar apparatus that is incompressible but extensible against the bias of a biasing means which mounts the trolling motor, along with another means providing a pivot mounting therefor. The bar assembly may include means for adjusting the length thereof for ready adaption to variously dimensioned existing trolling motor mounting apparatus. A "Protective Mounting for Outboard Motors" having a shock absorbing mechanism is detailed in U.S. Pat. No. 4,033,530, dated July 5, 1977, to Garrett H. Harris. Still other trolling motor brackets include an assist mechanism for assisting the folding and unfolding operation. My U.S. Pat. No. 4,634,390, dated Jan. 6, 1987, details a raising and lowering aid for trolling motors which includes a pair of torsion springs mounted in cooperation with a pair of connector bars and primary arms for assisting in the raising and lowering of a trolling motor to and from operational and retracted configurations. U.S. Pat. No. 3,930,461, dated Jan. 6, 1976, to Brock, et al, details an "Apparatus for Pivotally Mounting an Outboard Fishing Motor" and U.S. Pat. No. 4,708,670, dated Nov. 24, 1987, shows a "Retractable Trolling Motor Assembly". U.S. Pat. No. 3,674,228, dated July 4, 1972, to George F. Horton, details a "Bracket for Mounting Boat Accessory". The patent discloses an extensible hinge bracket for mounting a boat accessory, such as an auxiliary outboard electric motor or trolling motor, on the forward deck, gunwale or transom of a small boat and includes a horizontal mounting plate, spaced, generally parallel link arms pivotally connected at corresponding ends to the mounting plate for substantially 180° movement thereabove, the remaining ends of the link arms being spaced and pivotally connected to the ends of a movable support on which the accessory is mounted. A cushion is provided at one end of the mounting plate for supporting the accessory when the bracket is retracted.

The raising and lowering aid for trolling motors of this invention is designed for use with trolling motors mounted on bracket assemblies which are the same or similar in design to the Horton bracket detailed in U.S. Pat. No. 3,674,228, noted above, although the raising and lowering aid may be adapted for use with trolling motors mounted on various other type bracket assemblies. A primary object of this invention is to provide a means for aiding the user in both lowering a trolling motor into the water from a retracted position on the deck of a boat and raising the trolling motor back to the retracted position from the operating position.

Another object of this invention is to provide a new and improved raising and lowering aid for trolling motors, which utilizes a spring to exert an upward force on a movable element of the trolling motor mount such as the bow arm, to assist in lowering the trolling motor from a retracted position on the boat deck into the water and subsequently raising the trolling motor from the operating position back to the retracted position on the deck.

Still another object of this invention is to provide a raising and lowering aid for trolling motors of various design, which device is characterized by a spring-biased assist device having a foot member pivotally attached to a fixed portion of the trolling motor mount at or near the point of attachment of a movable portion of the trolling motor mount, which foot member pivotally anchors one end of a guide rod that extends through a compression spring located in a load case, which load case pivotally receives a pair of arms that extend to the foot member, such that raising the movable portion of the trolling motor mount and the trolling motor from the retracted position past a predetermined angle with respect to the deck of the boat causes the foot member to pivot with respect to the guide rod, load case and arms against the bias of the compression spring which operates to cushion the lowering of the trolling motor into operating position.

Yet another object of the invention is to provide a raising and lowering aid for assisting in the raising of a trolling motor from the water and cushioning the deployment of the trolling motor into operating position, which raising and lowering aid is further characterized by a compression spring, a guide rod securing one end of the compression spring and extending through the compression spring and mounted to a foot in pivotal relationship, which foot is pivotally attached to the deck channel at or near the point of attachment of the bow arm to the deck channel of the trolling motor mount, the raising and lowering aid further characterized by a hinge affixed to the bow arm or deck channel pivotally attaching a spring housing slidably mounted on the guide rod or by a pair of links, rods or bars pivotally attached to the foot or to the deck channel and to the spring housing, such that raising of the trolling motor from the operating position in the water causes the spring housing and guide rod to pivot with respect to the foot and release the tension in the compression spring, thereby assisting in raising the trolling motor from the water. Lowering the trolling motor into the operating position tensions the compression spring and assists in lowering the trolling motor into the water.

SUMMARY OF THE INVENTION

These and other objects of the invention are provided in a new and improved raising and lowering aid for trolling motors, which raising and lowering aid is designed to both cushion the deployment of a trolling motor and the movable elements of a trolling motor mount into operating position on the deck of a boat and lessen the effort needed to move the trolling motor from the operating position to the retracted position on the deck. The raising and lowering aid is characterized in a preferred embodiment by a foot member which is pivotally attached to the deck channel and the bow arm of the trolling motor mount by means of a pivot pin which joins the bow arm to the deck channel and further characterized by a guide rod having a spring retainer affixed thereto and extending from pivotal attachment to the foot member, through a load case or rod hanger which receives a compression spring, the bias of which is adjustable, with a pair of connecting bars or rods extending from pivotal attachment to the foot, to pivotal attachment to the load case or rod hanger, such that relative movement between the load case or rod hanger and the bars or rods with respect to the foot applies tension to the compression spring extending through the load case or rod hanger and assists in deploying the trolling motor into the operating position from the retracted position and in retrieving the trolling motor from the operating position back to the retracted position.

BRIEF DESCRIPTION OF THE DRAWINGS

The invention will be better understood by reference to the accompanying drawings, wherein:

FIG. 1 is a side view of a prior art trolling motor mount of the type illustrated in U.S. Pat. No. 3,674,228, to George F. Horton, with a trolling motor mounted thereon, more particularly illustrating typical retracted, intermediate and operating positions of the trolling motor mount;

FIG. 3 is a side view, partially in section, of the trolling motor mount, trolling motor shaft and raising and lowering aid illustrated in FIG. 2, detailed in the retracted position;

FIG. 4 is a side view, partially in section, of the trolling motor mount, trolling motor shaft and raising and lowering aid illustrated in FIG. 2, lowered to the operating position;

FIG. 10 is a top view, partially in section, of the trolling motor raising and lowering aid illustrated in FIG. 7, except in the operating position;

DESCRIPTION OF THE PREFERRED EMBODIMENTS

Figure 2:
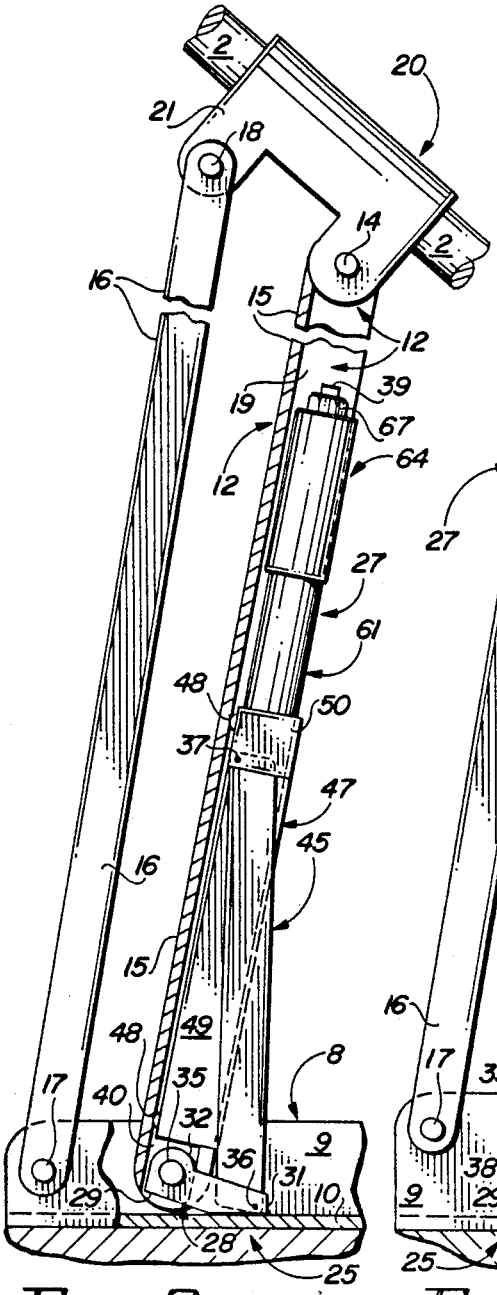
FIG. 2 is a side view, partially in section, of the trolling motor mount and trolling motor shaft illustrated in FIGURE 1, fitted with a first preferred embodiment of the raising and lowering aid of this invention, depicted in the intermediate position.

Referring initially to FIGS. 1, 3 and 4 of the drawings, a typical trolling motor mount 7, carrying a trolling motor 1 and having a fixed deck channel 8 mounted on the boat deck 25 of boat 24, is illustrated, with the trolling motor 1 characterized by a motor shaft 2, a drive unit 3 located at the lower end of the motor shaft 2 and having a propeller 4 mounted thereon and further including a head 5, located at the opposite end of the motor shaft 2, as illustrated in FIG. 1. A shaft bracket 20 engages and adjustably mounts the motor shaft 2 of the trolling motor 1 and is pivotally secured to one end of the bow arm flanges 19, extending from the bow arm channel plate 15 of a channel bow arm 12 and to one end of a pair of parallel outer arms 16, as illustrated. The ends of the outer arms 16 are typically pivotally attached to a top flange 21 of the shaft bracket 20 by means of an outer arm bracket pin 18, while the corresponding end of the channel bow arm 12 is secured to the bottom flange 22 of the shaft bracket 20 by means of a bow arm bracket pin 14. The opposite ends of the parallel outer arms 16 are secured to the channel flanges 9, respectively, extending from a base plate 10 in the deck channel 8, by means of an outer arm channel pin 17, while the opposite end of the channel bow arm 12 is pivotally attached to the channel flanges 9 by means of a mount pin 35. As further illustrated in FIG. 1, the trolling motor 1 can be pivoted into various positions with respect to the boat deck 25, including a fully retracted position over the boat deck 25, as illustrated in phantom, an intermediate position at an angle of approximately 80° with respect to the boat deck 25 and the operating position, also illustrated in phantom, with the drive unit 3 and the propeller 4 extended beneath the water surface 6.

Figure 5:
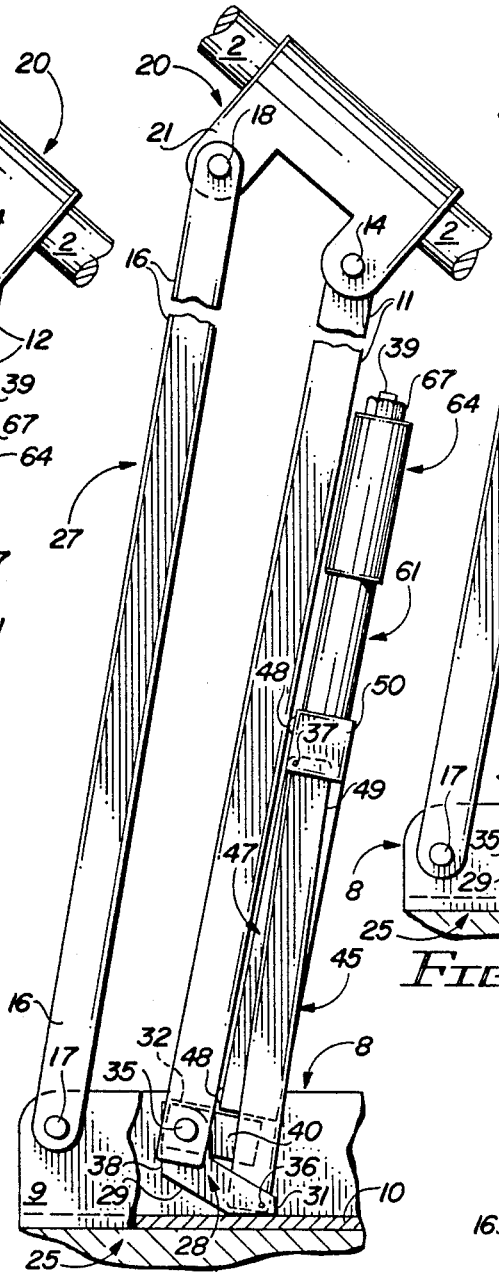
FIG. 5 is a side view, partially in section, of the trolling motor mount, trolling motor shaft and a second preferred embodiment of the trolling motor raising and lowering aid, illustrated in the intermediate position.
Figures 5A, 8, 9:
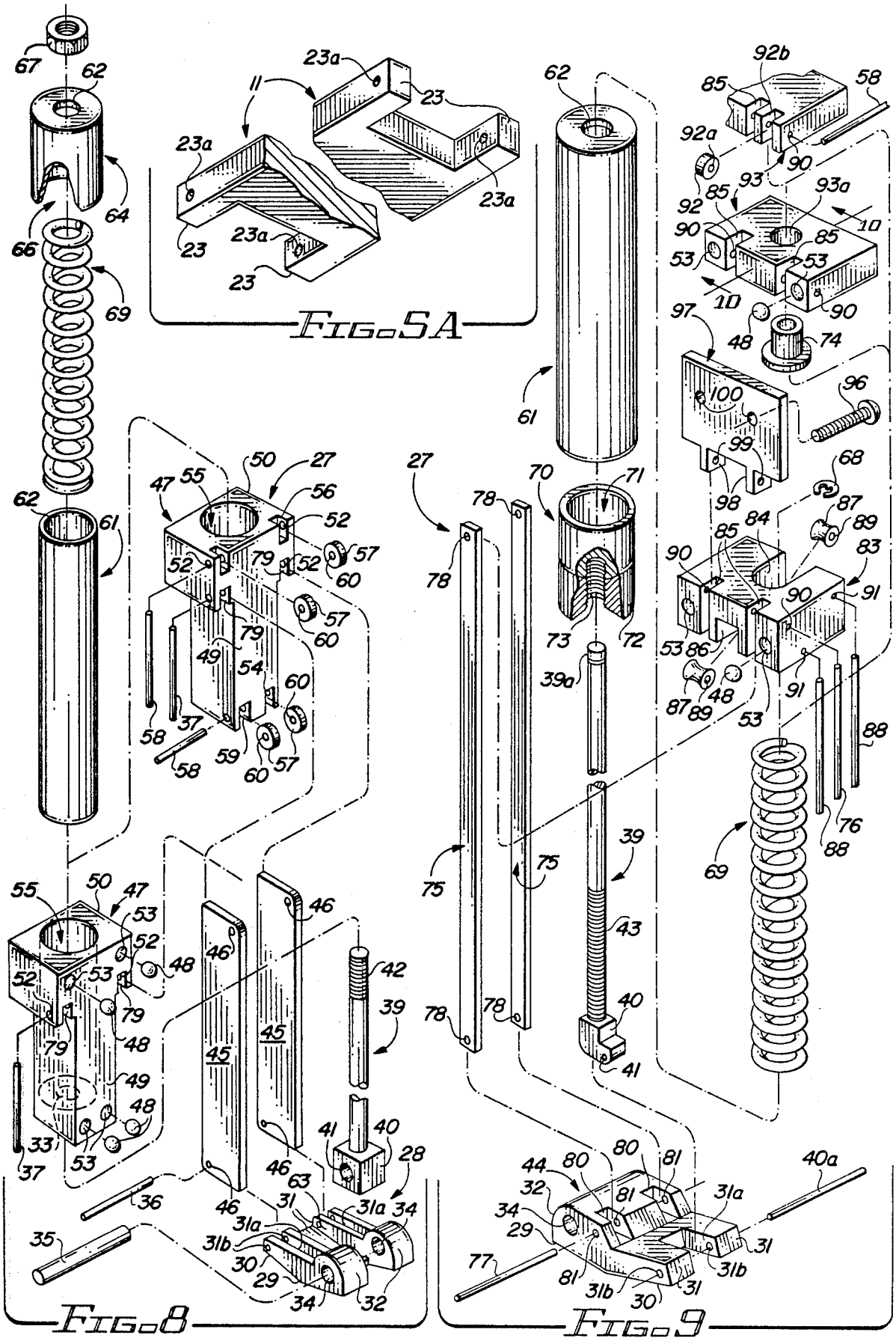
FIG. 5A is a perspective view, partially in section, of an alternative solid bow arm used in the trolling motor mount illustrated in FIG. 5.
FIG. 8 is an exploded view of the embodiment of the trolling motor raising and lowering aid illustrated in FIGS. 2–5.
FIG. 9 is an exploded view of the trolling motor raising and lowering aid illustrated in FIG. 6 including an alternative grooved harness rod hanger and hinge plate.

Referring now to FIGS. 2–4 and 8 of the drawings, the raising and lowering aid of this invention is generally illustrated by reference numeral 27 and in a first preferred embodiment, includes a deep slotted foot 28, which has a flat portion 29 and an angle portion 30, which angle portion 30 terminates in a toe end 31, provided with parallel toe end slots 31*a*, as further illustrated in FIG. 8. It will be appreciated that the deep slotted foot 28 is rotated 180 degrees as indicated by the arrow from the normal mounted configuration, for clarification as to design features. Aligned toe end pin openings 31*b* extend transversely through the toe end 31 of the deep slotted foot 28 and are designed to receive a lower push bar pin 36, in order to pivotally secure one end of the parallel push bars 45 to the deep slotted foot 28. The flat portion 29 of the deep slotted foot 28 terminates in a rounded heel 32 and a mount pin opening 34 projects through the rounded heel 32, as further illustrated in FIG. 8. A central slot 63 extends from the toe end 31 through the rounded heel 32 of the deep slotted foot 28 and is designed to accommodate a guide rod base 40, provided with a guide rod pin opening 41, in order to pivotally attach the guide rod base 40 to the rounded heel 32 of the deep slotted foot 28 by means of a mount pin 35, as further illustrated in FIG. 8. One end of an elongated guide rod 39 is fixedly attached to the guide rod base 40 and the opposite end of the guide rod 39 is fitted with guide rod threads 42, for purposes which will be hereinafter further described. The upper ends of the push bars 45 extend into companion push bar slots 79, provided in the load case T-section 50 of the load case 47, as further illustrated in FIG. 8. An upper push bar pin 37 is inserted in the registering T-section pin openings 52 and push bar pin openings 46, located in the push bars 45, to pivotally secure the top ends of the push bars 45 to the load case T-section 50. A load case leg 49 extends downwardly from the load case T-section 50 and in a first preferred embodiment of this aspect of the invention, a pair of bearing seats 53 are located in spaced relationship in both the load case T-section 50 and the load case leg 49, in order to receive a pair of slide bearings 48, respectively, and reduce friction between the load case 47 and the bow arm channel plate 15 of the trolling motor mount 7, as hereinafter further described. A load case leg opening 33 is provided in the bottom end of the load case leg 49 to accommodate the guide rod 39 and it will be appreciated that the bottom end of the compression spring 69 seats in the load case leg 49. As further illustrated in FIG. 8, the guide rod 39 extends from the guide rod base 40 through the load case 47 and the tube 61, which tube 61 is press fit in the load case bore 55, and a compression spring 69 fits inside the tube 61. A tube cap 64 includes a tube cap bore 66, for receiving the top end of the compression spring 69 and the tube 61 when the raising and lowering aid 27 is assembled as illustrated in FIGS. 2, 3 and 4. A guide rod nut 67 is threaded on the guide rod threads 42 of the guide rod 39, in order to assemble the component parts of the raising and lowering aid 27 as further illustrated in FIGS. 2–4 and 8 of the drawings and to adjust the tension in the compression spring 69. It will be appreciated that the compression spring 69, the load case 47, the guide rod 39 and the guide rod nut 67 may be replaced by a resilient, extendible element such as, for example, a rubber bar or a helical or gas extension spring or other resilient extendible element.

In an alternative preferred embodiment of the invention, the load case 47 of the raising and lowering aid 27 illustrated in FIG. 8 includes a pair of spaced, T-section roller slots 56, located in the load case T-section 50, and companion leg roller slots 59, provided in the bottom of the load case leg 49, in order to receive two sets of load case rollers 57, respectively. The load case rollers 57 are each provided with load case roller openings 60, that register with corresponding T-section pin openings 52 and leg pin openings 54, respectively, which are transversely situated in the load case T-section 50 and the load case leg 49, in order to rotatably mount the load case rollers 57 in the T-section roller slots 56 and in the leg roller slots 59, respectively, by means of the roller pins 58. It will be recognized by those skilled in the art that the load case rollers 57 serve the same purpose as the slide bearings 48 in reducing friction between the load case 47 and the bow arm channel plate 15, when the raising and lowering aid 27 is in operation.

Referring now to FIGS. 5 and 5*a* of the drawings, in another preferred embodiment of the invention the raising and lowering aid 27 is mounted on a trolling motor mount 7 which is characterized by a solid bow arm 11. This design feature dictates that the deep slotted foot 28, the guide rod base and the bottom of the solid bow arm 11 be of slightly different design and that the mount pin 35 in the parallel channel flanges 9 of the deck channel 8 be located a sufficient distance above the base plate 10 to permit the solid bow arm 11 to pivot to the operating position with the raising and lowering aid 27 being between the solid bow arm 11 and the base plate 10. The differing design of the deep slotted foot 28 illustrated in FIG. 5 and of the bottom end of the solid bow arm 11 illustrated in FIGS. 5 and 5*a* is such that the pivotal relationship between the two is basically the same as that between the first style deep slotted foot 28 and the channel bow arm 12, and the differing design of the guide rod base 40 is such to hold the guide rod 39 in a location relative to the solid bow 11 substantially the same as the location at which the first style guide rod base 40 holds the guide rod 39 relative to the bow arm channel plate 15. As further illustrated in FIG. 5A, the bottom end of the solid bow arm 11 is fitted with projecting, spaced solid bow arm flanges 23 for receiving the heel extension 38 of the deep slotted foot 28 and having flange openings 23*a* therein for receiving the mount pin 35.

Figure 6:
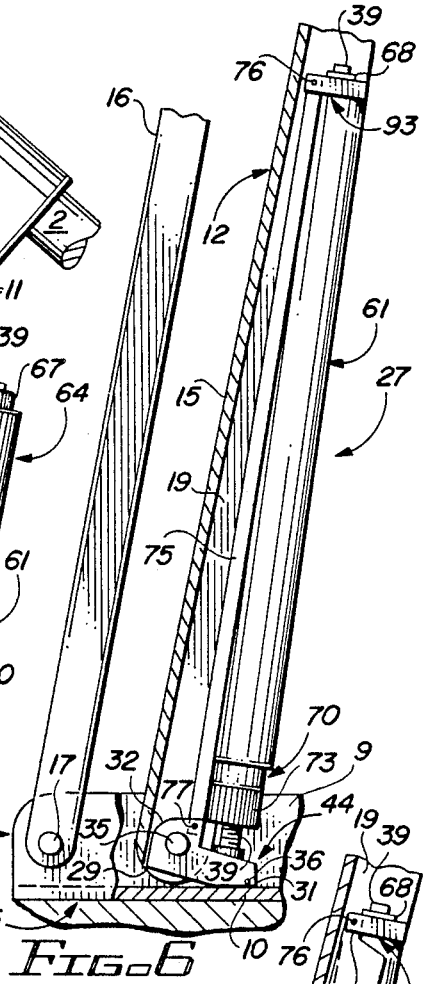
FIG. 6 is a side view, partially in section, of the trolling motor mount and another alternative preferred embodiment of the raising and lowering aid, illustrated in the intermediate position.

Referring now to FIGS. 6, 9, 12 and 13 of the drawings, in another preferred embodiment of the invention the raising and lowering aid 27 is fitted with a pair of elongated harness rods 75, and a shallow slotted foot 44, which is designed with a pair of harness rods slots 80 for receiving the bottom ends of the harness rods 75, respectively, and the harness rod pin openings 78 register with corresponding slot pin openings 81, provided transversely in the harness rod slots 80, to receive a lower harness rod pin 77 and pivotally secure the lower ends of the harness rods 75 to the shallow slotted foot 44. Like the deep-slotted foot 28 illustrated in FIG. 8, the shallow slotted foot 44 is provided with a flat portion 29 and an angle portion 30, which terminates at a toe end 31. The toe end 31 is further provided with a single toe end slot 31*a* and toe end pin openings 31*b*, for receiving a base mount pin 40*a*, in order to pivotally secure the L-shaped guide rod base 40, provided with a guide rod pin opening 41, to the toe end 31 of the shallow slotted foot 44. The shallow slotted foot 44 is further characterized by a rounded heel 32, which terminates at the flat portion 29 and includes a mount pin opening 34, which receives a mount pin 35, in order to mount the shallow slotted foot 44 inside the bow arm flanges 19 of the channel bow arm 12 as illustrated in FIG. 6. The top ends of the harness rods 75 are fitted with additional harness pin openings 78 for registration with corresponding hanger slot openings 90, provided in the parallel hanger slots 85 of a grooved harness rod hanger 83, as further illustrated in FIG. 9. An upper harness rod pin 76 extends through the transverse, registering hanger slot openings 90 and the harness rod pin openings 78, provided in the harness rods 75, respectively, to pivotally secure the top ends of the harness rods 75 to the grooved harness rod hanger 83. The grooved harness rod hanger 83 is further provided with an upper guide roller slot 84 and a lower guide roller slot 86, which rotatably receive a pair of spaced guide rod rollers 87, each having a guide roller opening 89, for receiving a pair of guide roller pins 88, respectively. The guide roller pins 88 extend through transverse, registering guide roller pin openings 91, provided in the grooved harness rod hanger 83 and the guide roller openings 89, provided in the guide rollers 87, such that the guide rollers 87 engage and roll upon the extending end of the guide rod 39, as the guide rod 39 projects through the upper guide roller slot 84 and the lower guide roller slot 86, provided in the grooved harness rod hanger 83. As further illustrated in FIG. 9, the guide rod 39 is provided with guide rod adjuster threads 43 located near the bottom end thereof above the guide rod base 40, in order to threadibly receive the adjuster threads 73 provided in the lower half of the adjuster 70, the upper half of which adjuster 70 is further fitted with an adjuster bore 71. Accordingly, as illustrated in FIG. 9, it will be appreciated that the raising ad lowering aid 27 is assembled by threadibly securing the adjuster 70 to the guide rod 39 by means of the adjuster threads 73 and the companion guide rod adjuster threads 43. The compression spring 69 is then fitted over the extending end of the guide rod 39 and seats in the adjuster bore 71 of the adjuster 70 and the tube 61 is subsequently fitted over the compression spring 69 and the guide rod 39. The grooved harness rod hanger 83 is then located over the extending end of the guide rod 39 and a rod clip 68 is seated in the clip groove **39*a* at the top of the guide rod 39, to ready the raising and lowering aid 27 for operation, as illustrated in FIG. 6. Accordingly, it will be recognized that the tension in the compression spring 69 can be adjusted by gripping the knurled surface 72 of the adjuster 70, rotating the adjuster 70 and thereby causing the adjuster 70 to travel upwardly or downwardly on the guide rod 39**.

Figure 7:
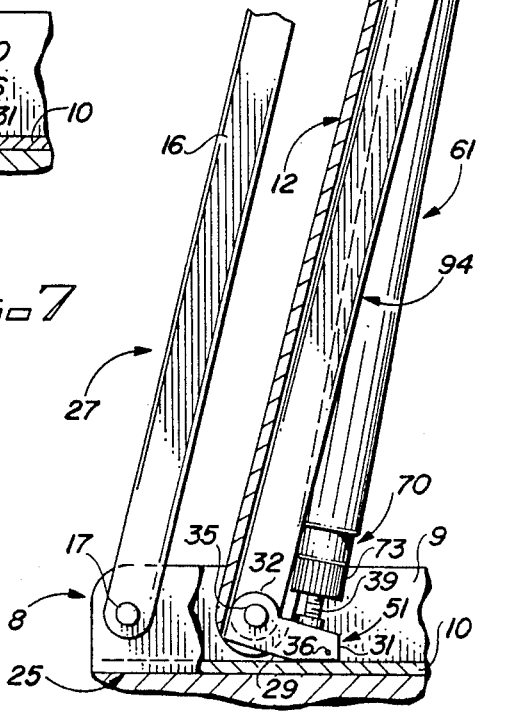
FIG. 7 is a side view, partially in section, of the trolling motor mount and still another alternative preferred embodiment of the trolling motor raising and lowering aid, illustrated in the intermediate position.
Figures 11, 12, 13, 14:
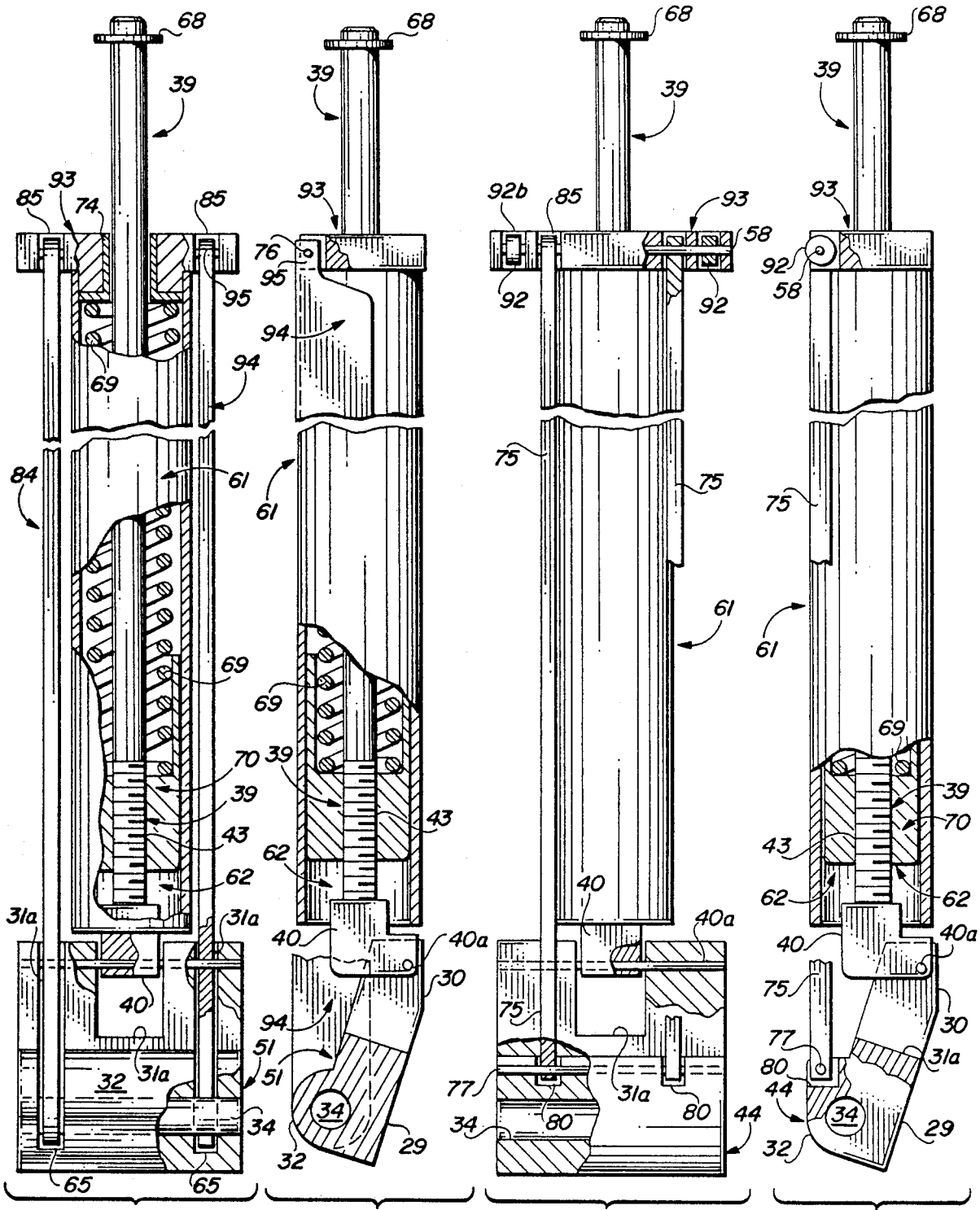
FIG. 11 is a side view, partially in section, of the trolling motor raising and lowering aid illustrated in FIG. 10.
FIG. 12 is a top view, partially in section, of the trolling motor raising and lowering aid illustrated in FIG. 6 except in the operating position.
FIG. 13 is a side view, partially in section, of the trolling motor raising and lowering aid illustrated in FIG. 12.

Referring now to FIGS. 7, 10 and 11 of the drawings, in yet another preferred embodiment of the invention the raising and lowering aid 27 includes a pair of harness bars 94, which extend between the harness bar foot 51 and the grooved harness rod hanger 83. The harness bars 94 are each fitted with a projecting harness bar tip 95 at the upper end thereof, for inserting in the hanger slots 85. The harness bar tips 95 are further provided with openings (not illustrated) for receiving an upper harness rod pin 76 and pivotally attaching the upper ends of the harness bars 94 to the grooved harness rod hanger 83. The lower ends of the harness bars 94 project into the spaced harness rod foot slots 65, as illustrated in FIG. 10, which extend through the mount pin opening 34, in order to receive the lower ends of the harness bars 94, for pivotal attachment to the harness bar foot 51 by means of the mount pin 35.

Referring again to FIGS. 6, 7 and 9–13, in still another alternative preferred embodiment of the invention a flat harness rod hanger 93 fixed to the upper end of the tube 61 as illustrated in FIG. 10, can be used in place of the grooved harness rod hanger 83, wherein a guide rod access **93*a* extends centrally through the flat harness rod hanger 93, in order to receive the upper end of the guide rod 39 and slidably mount the flat harness rod hanger 93 thereon. In a most preferred embodiment of this aspect of the invention a guide rod insert 74 is seated in the guide rod access 93*a* from the bottom, as illustrated in FIGS. 9 and 10. Furthermore, as in the case of the load case 47 illustrated in FIG. 8, both the grooved harness rod hanger 83 and the flat harness rod hanger 93 may be fitted with bearing seats 53, for receiving the companion slide bearings 48 and reducing friction between the grooved harness rod hanger 83 or the flat harness rod hanger 93 and the channel bow arm 12, as the raising and lowering aid 27 operates. Further in the alternative, a pair of hanger roller slots 92*b* are provided outwardly of the hanger slots 85, in order to receive a pair of hanger rollers 92, respectively, each provided with a hanger roller opening 92*a*, in order to receive a roller pin 58, which is inserted through the hanger slot openings 90 to rotatably mount the hanger rollers 92. It will be apparent to those skilled in the art that the hanger rollers 92 serve the same friction-reducing purpose as the slide bearings 48 and further apparent that the raising and lowering aid 27 embodiments illustrated in FIGS. 6, 7 and 9–13 can be made workable with a solid bow arm 11, as illustrated in FIG. 5A**.

Referring again to FIGS. 7 and 9 of the drawings, it will be appreciated by those skilled in the art that the harness bars 94, can be replaced by a hinge plate 97, which is secured to the bow arm channel plate 15 of the channel bow arm 12, or to the solid bow arm 11, illustrated in FIGS. 2 and 5, respectively, by means of a pair of plate bolts 96, which extend through the plate openings 100 in the hinge plate 97, and engage corresponding threaded openings (not illustrated) provided in the bow arm channel plate 15 or the solid bow arm 11. The hinge plate 97 is provided with downwardly-extending plate legs 98, having leg openings 99 projecting transversely therethrough. The plate legs 98 are inserted in the hanger slots 85 of the grooved harness rod hanger 83, or of the flat harness rod hanger 93, such that the leg openings 99 align with the transversely located hanger slot openings 90 and the upper harness rod pin 76 is inserted through the registering leg openings 99 and hanger slot openings 90, to pivotally attach the hinge plate 97 to the grooved harness rod hanger 83 or to the flat harness rod hanger 93.

Operation of the raising and lowering aid 27 of this invention will be described in connection with the illustrations in FIGS. 1–5 of the drawings. Referring initially to FIGS. 1 and 3, when the trolling motor 1 is in the retracted position, the compression spring 69 is extended in a more or less relaxed state inside the load case 47, with the deep slotted foot 28 positioned substantially in a vertical orientation as illustrated in FIG. 3. As the trolling motor 1 and movable parts of the trolling motor mount 7 are rotated in an arc to the intermediate position as illustrated in FIG. 2, the compression spring 69 remains relaxed inside the load case 47, since the deep slotted foot 28 simply rotates and pivots on the mount pin 35 with the channel bow arm 12. Further deployment of the trolling motor 1 and the movable parts of the trolling motor bracket 7 downwardly to the operating position illustrated in FIG. 4, causes the push bars 45 to begin pushing the load case 47 away from the guide rod base 40 and compressing the compression spring 69, as the angled portion 30 of the foot 28 remains stationary on the base plate 10 of the deck channel 8 and the bearing balls 48 traverse the bow arm channel plate 15. This action cushions the drop of the trolling motor 1 and the movable parts of the trolling motor mount 7, since the tension in the compression spring seated on the guide rod nut 67 operates to make the load case 47 biased to oppose the pushing of the push bars 45 which, in turn, makes the push bars 45 biased to pivot upward with the load case 47 against the bottom of a movable part of the trolling motor mount 7. This same action also operates to ease the pressure required on the part of the operator to lift the trolling motor 1 from the water, as tension is released from the compression spring 69 in the lifting operation. The bias of the push bars 45 and load case 47 to pivot upward ceases when the movable parts of the trolling motor mount 7 are located in the intermediate, approximate 80°, position. Further rotation of the trolling motor 1 and the trolling motor mount 7 to the retracted position illustrated in FIG. 3, simply pivots the foot 28 in concert with the channel bow arm 12 on the mount pin 35, without further adjustment of tension in the compression spring 69. The tension in the compression spring 69 and, thus, the bias of the push bars 45 and load case 47 may be adjusted by turning the guide rod nut 67 on the guide rod threads 42.

It will be appreciated that the raising and lowering aid of this invention constitutes a convenient and useful assist device for trolling motor mounts of various design, in order to lessen the effort expended in raising a trolling motor from the water and to reduce the likelihood of damaging the trolling motor mount when the trolling motor is deployed into operating position.

While the preferred embodiments of this invention have been described above, they are illustrative only, and there are many possible variations. Examples are: (a) the use of a gas compression or gas vacuum spring in lieu of or in conjunction with a helical spring, (b) the use of an extension spring in lieu of a compression spring, (c) the use of two or more springs powering a single raising and lowering aid (d) the use of resilient means other than a helical spring or gas spring, (e) the elimination of or change in the method of spring tension adjustability and, thus, of the parts and part features required therefor, (f) elimination of the tube and the tube cap (g) replacing the tube and the tube cap with a closed-end tube fastened to the load case and entirely containing the compression spring, the guide rod and the guide rod nut, (h) the slide bearings being a molded part of the load case or of the harness hanger (i) the position of the raising and lowering aid relative to the bow arm and the deck channel being reversed so that its slide bearings work upon the base plate of the deck channel instead of upon the bow arm and that the angled portion of the foot contacts the bow arm at the intermediate position instead of the base plate of the deck channel, (j) the foot member being pivotally attached to either a fixed portion or a movable portion of the mount at a point near the intersection of the two portions instead of directly at the intersection, (k) the raising and lowering aid being adapted and used for assisting the tilting of a transom mounted trolling motor or other outboard motor and, (l) the raising and lowering aid being used for purposes other than assisting the raising and lowering of a trolling motor. Many other variations and alternative forms of this invention will become apparent as a result of the disclosures made in this document and the appended claims are intended to cover all such variations and alternative forms which may fall within the spirit and scope of the invention.

What is claimed is:

1. A raising and lowering aid adapted for attachment to a trolling motor mount, said mount having a fixed portion and a movable portion pivotally attached to the fixed portion, said raising and lowering aid comprising essentially three elements hinged together in triangular relationship, with a first one of said elements comprising foot means pivotally attached at one end to the trolling motor mount, a second one of said elements comprising resilient means pivotally attached at one end to said foot means and the third of said elements comprising connecting means having one end pivotally attached to said foot means and the opposite end pivotally attached to said resilient means so that the movement of the movable portion of the trolling motor mount from a retracted position to an operating position causes said foot means to pivot with respect to the fixed portion of the trolling motor mount and said three elements to pivot cooperatively against the bias of said resilient means, whereby said raising and lowering aid provides resistance to the downward movement of the movable portion of the trolling motor mount from an intermediate position into the operating position and an upward force on said movable portion from the operating position back to the intermediate position.

2. The raising and lowering aid of claim 1 wherein said resilient means further comprises a compression spring, a guide rod extending through said compression spring, a spring retainer affixed on said guide rod at one end of said compression spring and spring carrying means slidably mounted on said guide rod, said guide rod having one end adapted for pivotal attachment to said foot means and said spring carrying means having a portion adapted for pivotal attachment to said opposite end of said connecting means.

3. The raising and lowering aid of claim 2 wherein said foot means further comprises a foot member having one end adapted for pivotal attachment to said one end of said guide rod and having the opposite end adapted for pivotal attachment to said one end of said connecting means.

4. The raising and lowering aid of claim 3 wherein said connecting means further comprises a pair of elongated connecting members having one end adapted for pivotal attachment to said opposite end of said foot member and the opposite end of said connecting members adapted for pivotal attachment to said portion of said spring carrying means adapted for pivotal attachment to said connecting means.

5. The raising and lowering aid of claim 3 wherein said connecting means comprises a portion of the trolling motor mount with one end of said portion pivotally attached to said opposite end of said foot member and with the opposite end of said portion having a hinge fixedly connected thereto for pivotally attaching said portion of said spring carrying means adapted for pivotal attachment to said connecting means.

6. The raising and lowering aid of claim 2 further comprising adjusting means for adjusting the magnitude of said resistance and said upward force.

7. The raising and lowering aid of claim 6 wherein said guide rod is partially threaded and said spring retainer is threaded for threadibly receiving said guide rod to allow selective positioning of said spring retainer and one end of said compression spring on said guide rod for obtaining a desired amount of bias of said compression spring.

8. The raising and lowering aid of claim 1 further comprising adjusting means for adjusting the magnitude of said resistance and said upward force.

9. A raising and lowering aid for mounting on a trolling motor mount, the mount having a fixed portion and a movable portion pivotally attached to the fixed portion, the movable portion adapted for carrying a trolling motor, said raising and lowering aid comprising foot means pivotally attached to the fixed portion and the movable portion of the trolling motor mount; a resilient operating means having one end pivotally attached to said foot means; and connecting means having one end pivotally attached to said foot means and the opposite end of said connecting means pivotally attached to said resilient operating means, whereby pivotal rotation of the movable portion of the trolling motor mount to an operating position pivots said foot means with respect to the fixed portion of the trolling motor mount and pivots said foot means, said resilient operating means and said connecting means against the bias of said resilient operating means, thereby cushioning the lowering of the trolling motor into the operating position and aiding in raising the trolling motor from the operating position.

10. The raising and lowering aid of claim 9 wherein said resilient operating means further comprises a compression spring, a guide rod extending through said compression spring, said guide rod having one end pivotally attached to said foot means, a spring retainer affixed to said guide rod at one end of said compression spring, and spring carrying means slidably mounted on said guide rod, with said spring carrying means pivotally attached to said connecting means.

11. The raising and lowering aid of claim 10 wherein said foot means further comprises a foot member provided with a heel portion and a toe portion and further comprising a heel adapted for pivotal attachment to said one end of said connecting means and a toe portion adapted for pivotal attachment to said guide rod, whereby said connecting means pivot in concert with respect to said foot means when said foot means pivots responsive to pivotal rotation of the movable portion of the trolling motor mount.

12. The raising and lowering aid of claim 11 wherein said connecting means further comprises a pair of elongated connecting members.

13. The raising and lowering aid of claim 11 wherein said connecting means further comprises a portion of the trolling motor mount and a hinge fixedly connected to said movable portion of the trolling motor mount.

14. A raising and lowering aid for mounting on a trolling motor mount, said mount having a fixed portion and a movable portion pivotally attached to said fixed portion, said movable portion adapted for carrying a trolling motor, said raising and lowering aid comprising foot means pivotally attached to the fixed portion and the movable portion of the trolling motor mount; a guide rod having one end pivotally attached to said foot means and a compression spring encircling said guide rod; a spring retainer affixed to said guide rod at one end of said compression spring, spring carrying means slidably mounted on said guide rod for carrying the opposite end of said compression spring; and connecting means having one end pivotally attached to said foot means and the opposite end of said connecting means pivotally attached to said spring carrying means, whereby pivotal rotation of the movable portion of the trolling motor mount from a retracted position to an operating position pivots said foot means with respect to said connecting means, said guide and said spring carrying means, thus compressing said compression spring and operating to cushion the lowering of the trolling motor into the operating position, and pivotal rotation of the movable portion from an operating position to a retracted position releases tension in said compression spring which operates to aid in lifting the trolling motor.

15. The raising and lowering aid of claim 14 further comprising adjusting means threadibly carried by said guide rod, said adjusting means cooperating with said compression spring, whereby tension in said compression spring is adjusted responsive to manipulation of said adjusting means.

16. The raising and lowering aid of claim 15 wherein said foot means further comprises a foot member provided with a heel portion and a toe portion and further comprising a heel receptacle provided in said heel portion for receiving and pivotally attaching said one end of said guide rod and a pair of toe receptacles provided in said toe portion for receiving and pivotally attaching said one end of said connecting means, whereby said connecting means pivot in concert with respect to said spring carrying means and said foot means when said foot member pivots responsive to pivotal rotation of the movable portion of the trolling motor.

17. The raising and lowering aid of claim 16 wherein said connecting means further comprises a pair of elongated connecting members.

18. The raising and lowering aid of claim 17 wherein said spring carrying means further comprises an internal bore for receiving said guide rod and said compression spring and further comprising connection receptacles located in said spring carrying means for receiving and attaching said opposite end of said connecting members in pivoting relationship.

19. The raising and lowering aid of claim 18 further comprising frictionreducing means carried by said spring carrying means for reducing the contact friction between said spring carrying means and the trolling motor mount responsive to rotation of the trolling motor mount from an intermediate position into the operating position and back to the intermediate position.

20. The raising and lowering aid of claim 14 further comprising pin means connecting the fixed portion and the movable portion of the trolling motor mount, said pin means extending through said one end of said connecting means and said foot means.

21. The raising and lowering aid of claim 20 further comprising adjusting means threadibly carried by said guide rod, said adjusting means cooperating with said compression spring, whereby tension in said compression spring is adjusted responsive to manipulation of said adjusting means.

22. The raising and lowering aid of claim 21 wherein said connecting means further comprises a pair of elongated connecting members and said spring carrying means further comprises an internal bore for receiving said guide rod and said compression spring, and connection receptacles located in said spring carrying means for receiving said opposite end of said connecting members in pivoting relationship.

23. The raising and lowering aid of claim 22 further comprising frictionreducing means carried by said spring carrying means for reducing the contact friction between said spring carrying means and the trolling motor mount responsive to rotation of the trolling motor mount from an intermediate position into the operating position and back into the intermediate position.

24. The raising and lowering aid of claim 14 wherein the movable portion of the trolling motor mount carries said raising and lowering aid in tact from an intermediate position back to the retracted position.

25. The raising and lowering aid of claim 24 wherein said foot means further comprises a foot member having a heel portion so fitted with respect to said movable portion of the trolling motor mount that pivotal rotation of said foot member with respect to said movable portion is limited such that, when said movable portion is rotated from an intermediate position back to the retracted position, said foot member is carried back, together with the rest of said raising and lowering aid in tact, by said movable portion.

* * * * *